US007647707B2

(12) United States Patent
Manley et al.

(10) Patent No.: US 7,647,707 B2
(45) Date of Patent: Jan. 19, 2010

(54) TEMPLATE AND METHOD TO PREPARE VARIOUS FABRICS TO RECEIVE A DECORATIVE EDGING

(75) Inventors: Byron Jeffrey Manley, 5892 Bridgemont Pl., Acworth, GA (US) 30101; Marleen Rose Manley, 5892 Bridgemont Pl., Acworth, GA (US) 30101

(73) Assignees: Byron Jeffrey Manley, Acworth, GA (US); Marleen Rose Manley, Acworth, GA (US)

( * ) Notice: Subject to any disclaimer, the term of this patent is extended or adjusted under 35 U.S.C. 154(b) by 0 days.

(21) Appl. No.: 11/891,380

(22) Filed: Aug. 10, 2007

(65) Prior Publication Data

US 2008/0052940 A1 Mar. 6, 2008

Related U.S. Application Data

(60) Provisional application No. 60/841,602, filed on Aug. 31, 2006.

(51) Int. Cl.
*G01B 3/14* (2006.01)

(52) U.S. Cl. ..... 33/563; 33/13; 33/1 F

(58) Field of Classification Search ..... 33/562, 33/563, 565, 566, 11–13, 483–485, 489, 33/493–494, 476, 1 F, 1 G
See application file for complete search history.

(56) References Cited

U.S. PATENT DOCUMENTS

| | | | | | |
|---|---|---|---|---|---|
| 1,995,204 | A * | 3/1935 | Ford | 33/476 |
| 3,639,988 | A * | 2/1972 | Impastato | 33/11 |
| 3,664,026 | A * | 5/1972 | Lawson | 33/759 |
| 4,074,437 | A * | 2/1978 | Kindersley | 33/41.2 |
| 4,345,383 | A * | 8/1982 | Corsette | 33/474 |
| 4,446,624 | A * | 5/1984 | Nowell et al. | 33/1 C |
| 4,524,522 | A * | 6/1985 | Perry | 33/11 |
| 5,052,118 | A * | 10/1991 | Beitler | 33/563 |
| 5,063,684 | A * | 11/1991 | Winters | 33/653 |
| 5,419,054 | A * | 5/1995 | Stoneberg | 33/474 |
| 5,444,920 | A * | 8/1995 | Nelson | 33/494 |
| 5,966,824 | A * | 10/1999 | Vazquez | 33/11 |
| 6,276,070 | B1 * | 8/2001 | Hawley | 33/563 |
| 6,889,442 | B2 * | 5/2005 | Bouvier | 33/492 |

* cited by examiner

*Primary Examiner*—Yaritza Guadalupe-McCall

(57) ABSTRACT

A template designed to prepare various fabrics for the attachment of a decorative crocheted edge. The transparent triangular shaped template contains holes at equally spaced intervals with uniform distance from the edge of the template. The corner of the template has been designed with a radial edge for use as a pattern to cut fabric. This is done with a rotary cutter. An awl is inserted into each hole of the template piercing the fabric leaving it with exposed holes to affix the decorative crocheted edge. A marking instrument can be inserted into the holes to mark a consistent layout on the fabric for future piercing. Further, the template can be used for squaring and trimming the fabric prior to the piercing process.

4 Claims, 7 Drawing Sheets

TEMPLATE AND METHOD TO PREPARE VARIOUS FABRICS TO RECEIVE A DECORATIVE EDGING

CROSS-REFERENCE TO RELATED APPLICATIONS

60/841,602 filed Aug. 31, 2006

FEDERALY SPONSORED RESEARCH

None

SEQUENCE LISTING

None

BACKGROUND OF THE INVENTION

1. Field of Invention

Figure 1:
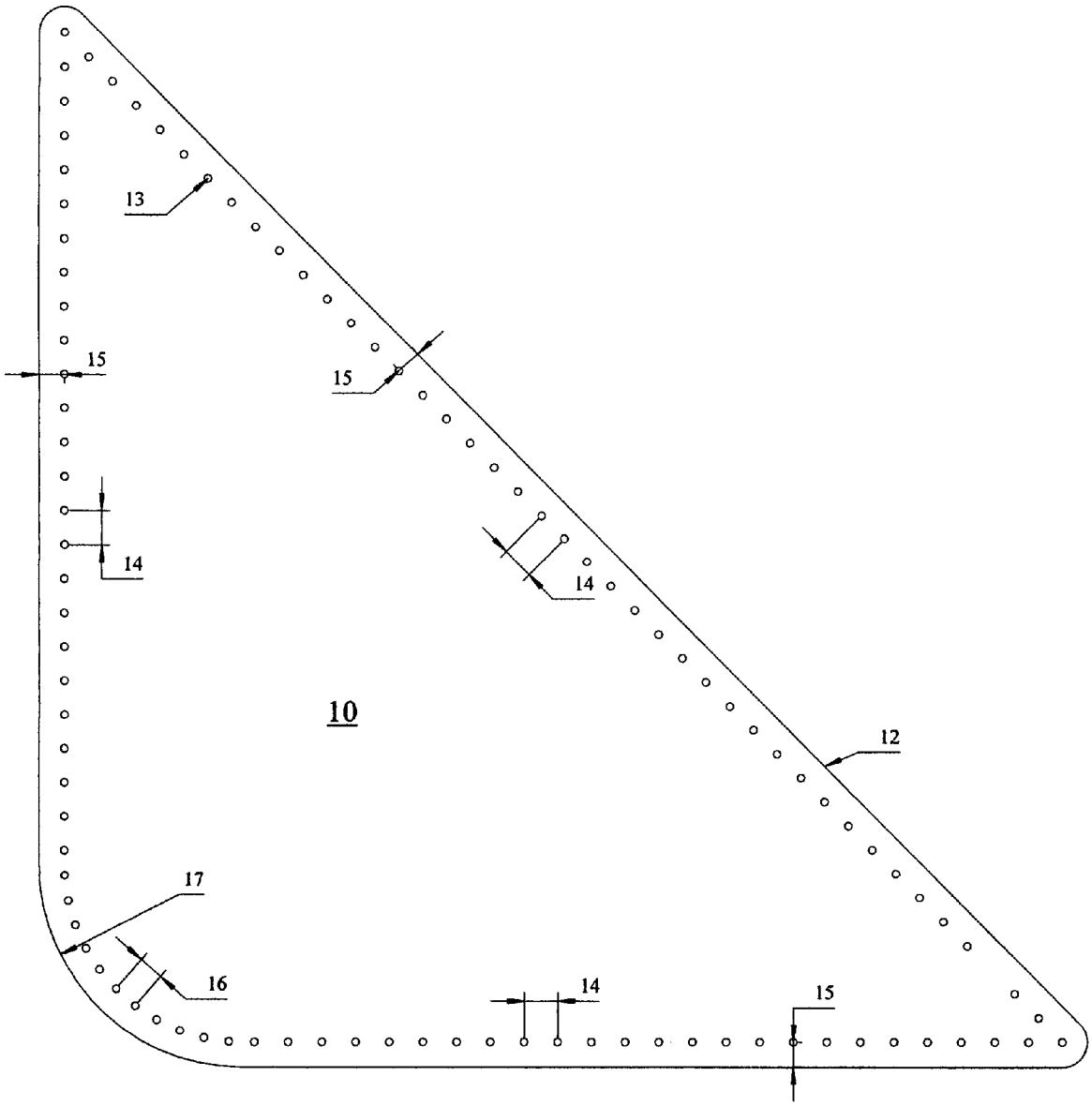

This invention relates to the method of preparing various fabrics for the installation of a decorative crocheted edge. To be more specific, the invention relates to a template used to guide a piercing, cutting or marking instrument as part of the preparation process.

2. Prior Art

Crafters have been putting decorative edgings on handcrafted or purchased articles for many years. For example, adding a decorative crocheted edge onto blankets, towels, bed linen, table linen, window dressings and many others. There are numerous patterns and books of instruction on how to make many styles of crocheted edgings, however, very few indicate a method to affix the edging onto the article. The few books and patterns that do indicate a method of installation instruct the consumer to pierce the article using the sharp end of a barbecue skewer, ice pick, the tip of scissors or other such pointed instrument. None that would provide consistency in spacing or a tool or method that would be safe for the consumer. What is needed is a template that would provide a safe and consistent method of preparing the article to receive the decorative edging.

3. Objectives and Advantages

The main objective and advantage of the invention is that it provides the consumer with a unique and convenient template with which to prepare an article that is to receive a decorative edging. The preparation method allows for holes to be safely pierced at consistent intervals that will be utilized to crochet or otherwise sew the edging to the article. Additionally, the invention can be used in the squaring and trimming processes of fabric or materials. Additional objectives and advantages will become apparent from a study of the following description and the accompanying drawings.

SUMMARY

The present invention provides a template for accurately piercing or marking numerous variations of fabric for the purpose of installing a decorative crocheted edge. The template is in the shape of an isosceles right triangle that embodies holes at equally spaced intervals along the 3 straight sides with equal distances from the edge. The larger radius corner contains holes with slightly lesser spaced intervals with equal distances from the edge. The template is formed of a material of sufficient thickness to provide constant rigidity to guide a sharp pointed handheld awl to pass through the template and fabric leaving a visible hole. The template's edge is used as a pattern to guide a rotary cutting device to round off the corner of the fabric. The template is formed of a substantially transparent material for viewing the fabric to be trimmed, pierced or marked through the template assuring accurate positioning. The template is used in the fabric squaring process prior to trimming, piercing or marking.

DRAWINGS REFERENCE NUMERALS

| | |
|---|---|
| 10 | template |
| 12 | PETG thickness .125" |
| 13 | hole diameter .1097" |
| 14 | .500" hole spacing |
| 15 | .375" from edge |
| 16 | .375" hole spacing |
| 17 | radius corner |
| 18 | alignment pin |
| 20 | fabric |

DRAWINGS

FIG. 1—plan view of the template according to the invention.

FIG. 2*a-f*—perspective view drawings of the invention operation.

DETAILED DESCRIPTION OF THE INVENTION

This invention provides a trimming and piercing template (10) for accurately preparing various fabrics (20) for the installation of a decorative crocheted edging. The nature of the fabric (20) may vary according to the intended purpose. By way of example, the fabric (20) may take the form of fleece as used for making blankets or the fabric (20) may take the form of cotton as used in table linens, bed linens and the like. In practicing the invention, it is preferred that the fabric be placed upon a surface suitable for use with a rotary type cutter for trimming or a fiberboard type material for piercing.

Referring to FIG. 1, the template (10) is in the shape of an isosceles right triangle, formed of a substantially transparent material. The two equal sides of the template (10) are 15.56" in length and the remaining side has a length of 21.70".

The template (10) is intended to be transparent and reusable. Therefore, the template (10) is constructed from the material Polyethylene Terephtalate Glycol (PETG) that is relatively inexpensive, transparent, resists wear, and which allows trimming and piercing. The transparency of the template (10) allows for viewing and/or aligning the fabric (20) prior to trimming with a cutting tool or piercing with an awl, as shown in FIG. 2.

Referring to FIG. 1, the template (10) is formed of a material of sufficient thickness (12) to provide constant rigidity to guide a rotary cutter safely and firmly around the template (10) edges to trim the fabric (20) and to guide an awl safely and firmly into the holes (13) to pierce the fabric (20).

The template (10) embodies holes (13) that are of a dimension of 0.1097" (3/32") and that are at equally spaced intervals (14) along the 3 straight sides with equal distance of 0.375" from the edge (15). These holes (13) are used to guide a sharp pointed handheld awl to pass through the template (10) and fabric (20) leaving a visible hole. The hole that has then been pierced into the fabric (20) will be the instrument to attach the decorative edging.

The larger radius corner (17) has a radius of 3.00" and is a 90-degree corner. This corner (17) contains holes (13) with slightly lesser spaced intervals (16) with equal distances from the edge (15). The lesser spacing allows for the decorative edging to lay flat when being attached to a rounded corner in the fabric (20). The outside edge of the larger radius corner (17) of the template (10) is used as a guide for the rotary cutter to round the fabric (20) corners during the trimming process.

The holes (13) on both straight edges of the template (10) and larger radius corner (17) of the template (10) can also be used to insert a marking instrument to mark a consistent and accurate layout onto the fabric (20) for later piercing.

The template (10) edges are substantially straight and can be used in the fabric (20) squaring process prior to trimming, piercing or marking.

Operation

The manner of using the template (10) may vary according to the intended purpose. For purposes of example and to provide an operational instruction, the example of a blanket made of fleece will be used.

The fabric (20) will be laid out flat on the cutting surface. Fold the fabric (10) in half keeping the edges as straight and even as possible. Fold the fabric (20) in half again so that the fabric (20) is now quartered (4 layers).

Figure 2A:
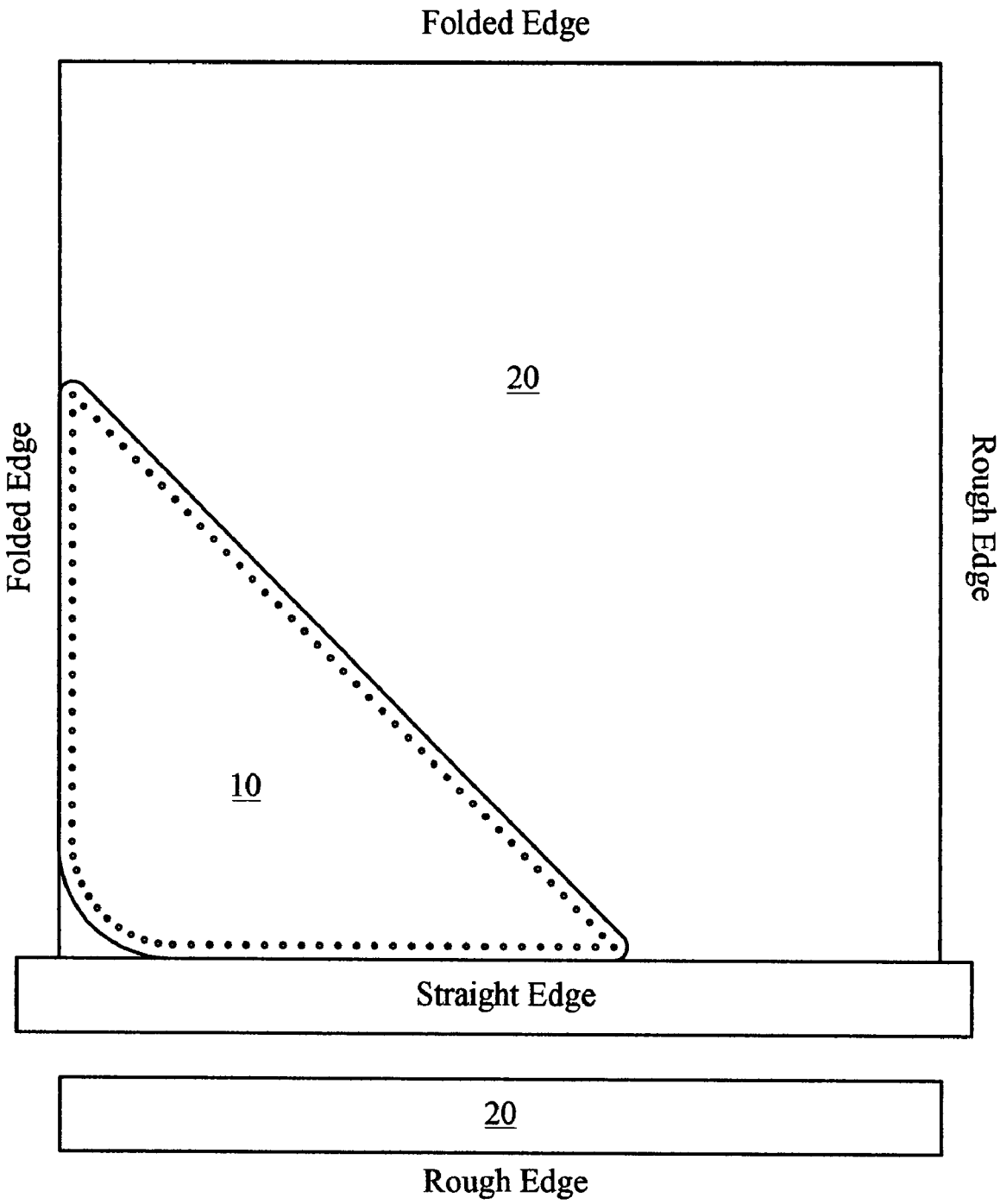
Figure 2B:
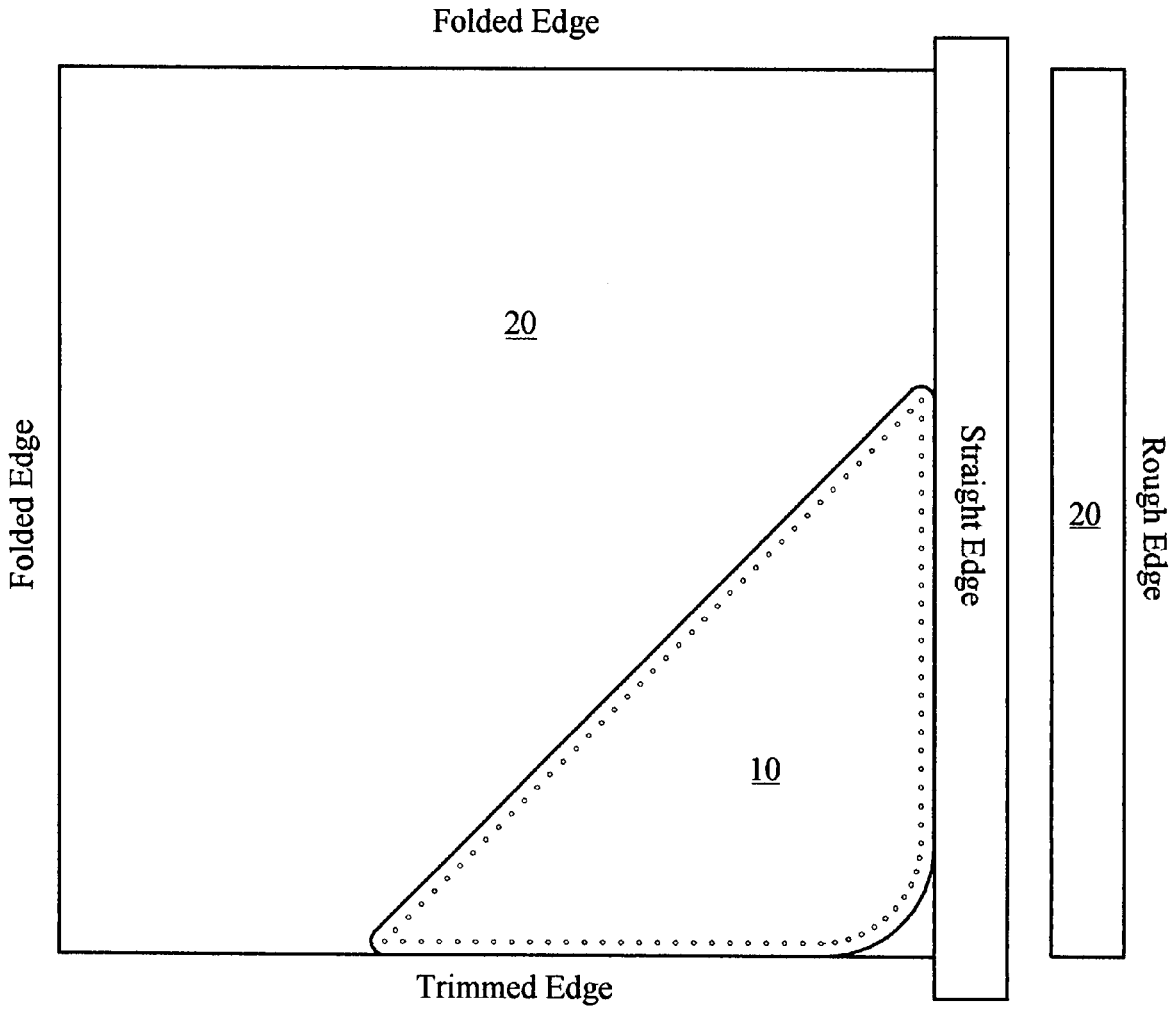
Figure 2C:
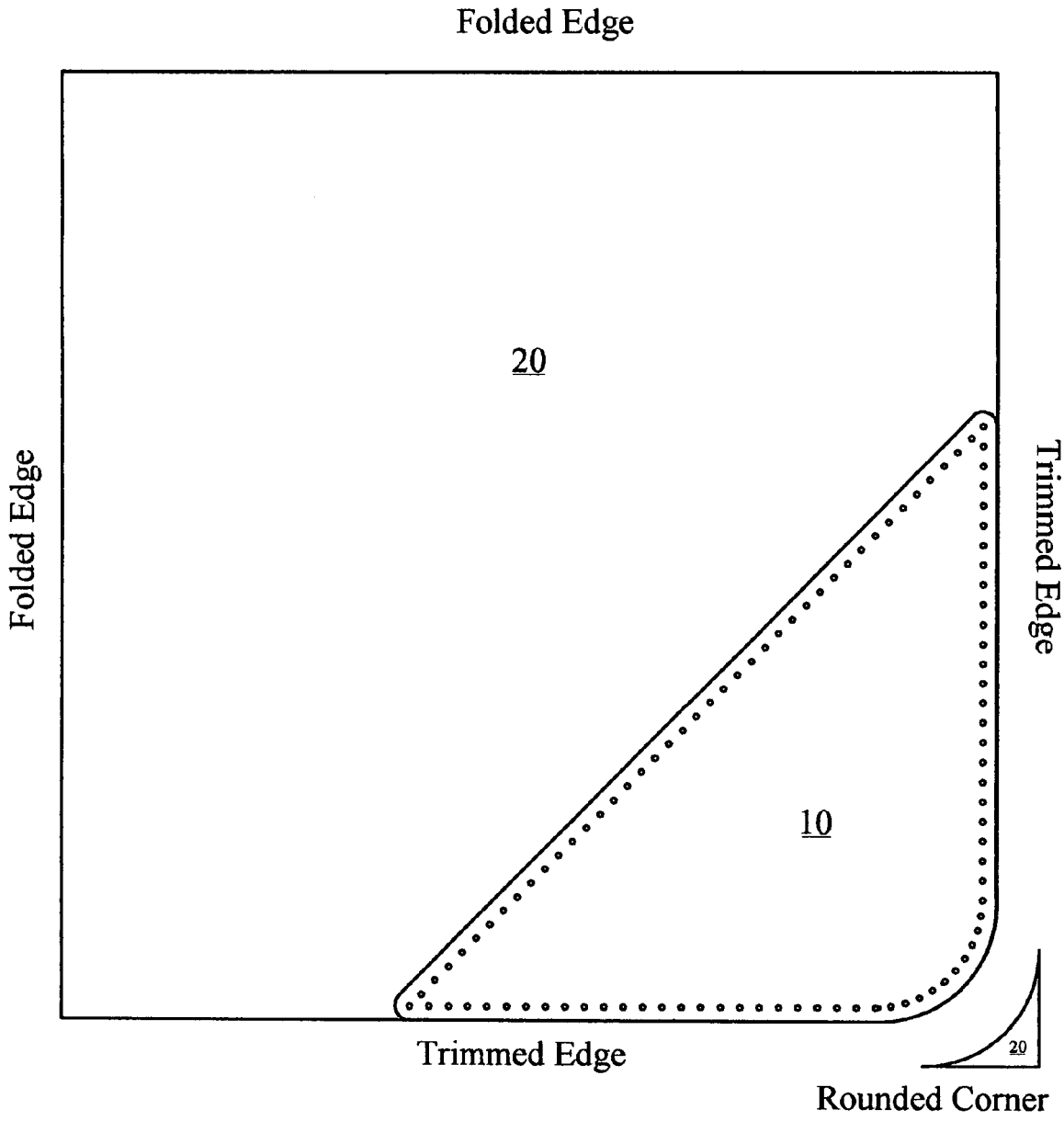

To trim the fabric (20), refer to FIGS. 2*a-c*.

FIG. 2*a*. Using the right angle of the template (10), align one edge of the template (10) to one of the folded edges of the fabric (20). Align the straightedge parallel to the opposing edge of the templates (10) right angle. Move the template (10) and straightedge, maintaining alignment, along the folded edge until the proper amount of fabric (20) to be trimmed is exposed (4 layers). Cut along the straightedge using a rotary cutter.

FIG. 2*b*. Align the template (10) with the newly trimmed edge of the fabric (20). Following the procedure in FIG. 2*a*, align the straightedge parallel to the opposing edge of the templates (10) right angle. Move the template (10) and straightedge, maintaining alignment, along the trimmed edge until the proper amount of fabric (20) to be trimmed is exposed (4 layers). Cut along the straightedge using a rotary cutter.

FIG. 2*c*. Align the right angle of the template (10) along the trimmed edges of the fabric (20). Using the rotary cutter, trim along the radius corner (17) of the template (10) to round off the fabric (20).

Figure 2D:
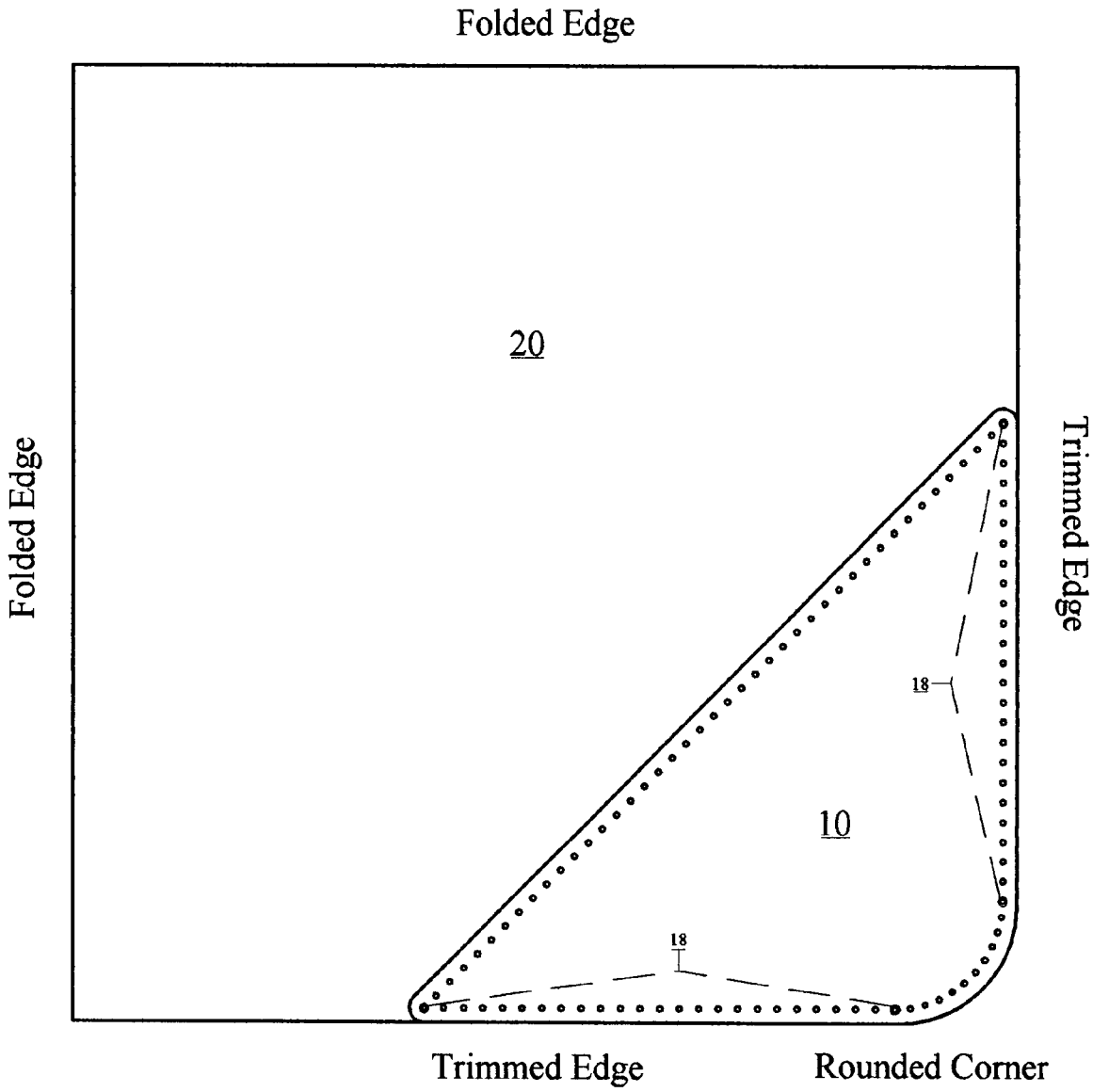
Figure 2E:
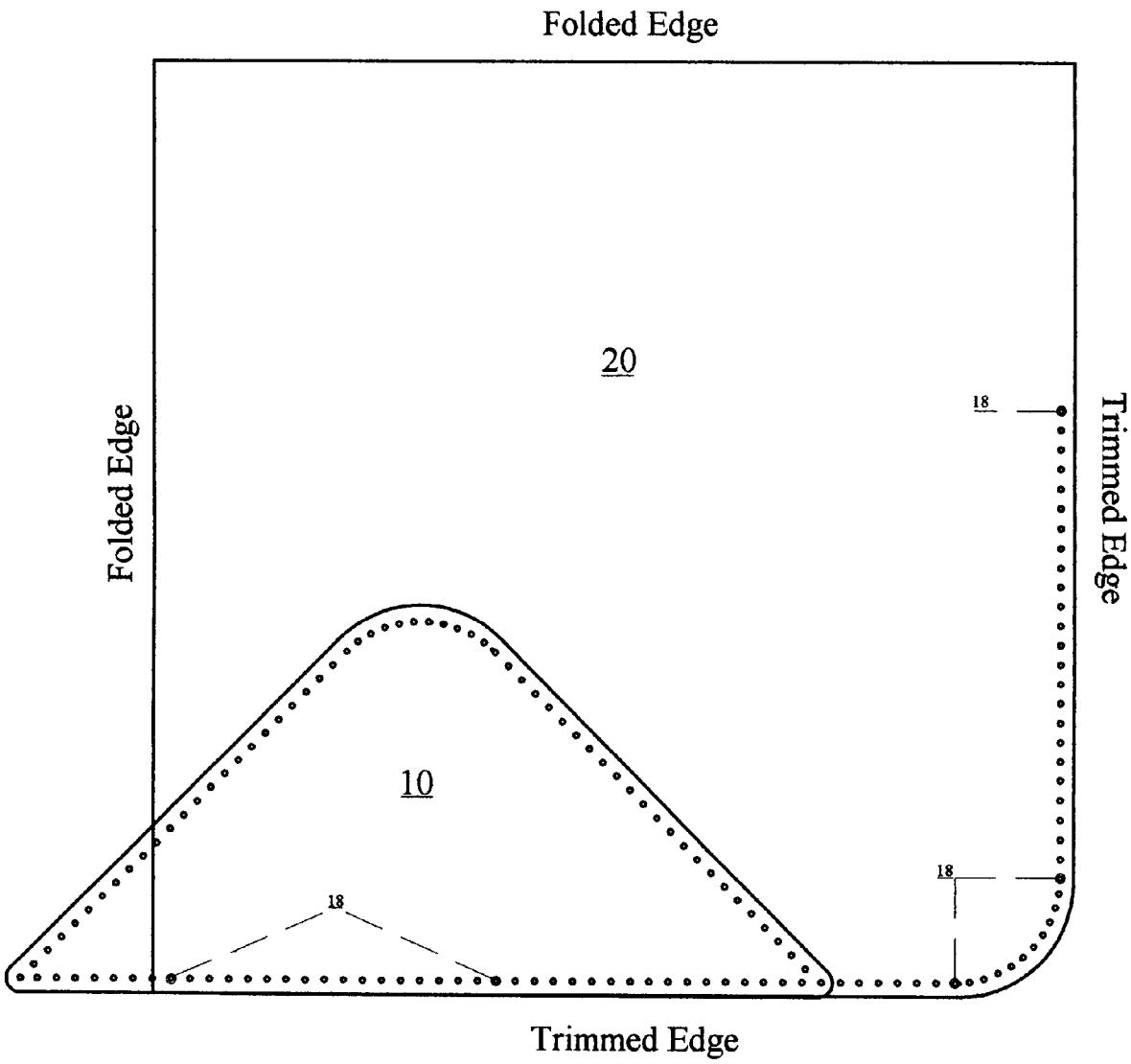
Figure 2F:
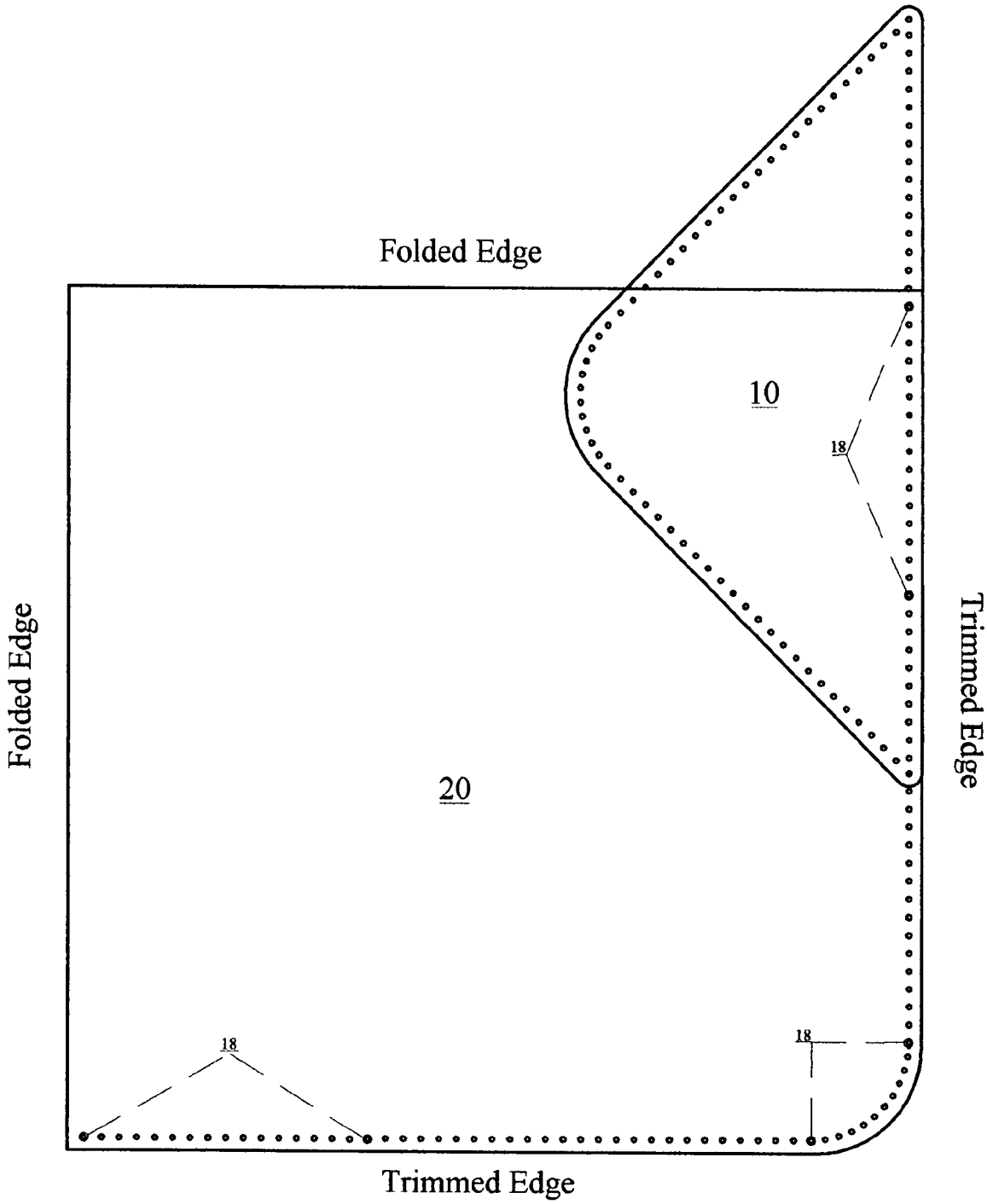

To pierce the fabric (20), refer to FIGS. 2*d-f*.

FIG. 2*d*. Position the fabric (20) onto the piercing surface, maintaining trimmed edge alignment (4 layers). Place the template (10) onto the fabric (20) aligning the right angle of the template (10) along the trimmed edges of the fabric (20) as in FIG. 2*c*, matching up the trimmed rounded corner of the fabric (20) and the radius corner (17) of the template (10). Hold the template (10) into position firmly with one hand. Using an awl, pierce one hole (13) at the center of the radius corner (17) through the template (10), all 4 layers of fabric (20) and into the piercing surface. Place one alignment pin (18) into the hole (13) just pierced, through the fabric (20) and into the piercing surface. Pierce the holes (13) at both ends of the right angle of the template (10), piercing through all 4 layers of fabric (20) and into the piercing surface and insert alignment pins (18). The alignment pins (18) maintain accurate template (10) placement on the fabric (20). Continue fabric (20) piercing through the remaining holes (13) on the right angle and radius edge (17) of the template (10).

FIG. 2*e*. Leaving alignment pins (18) in place, lift and remove the template (10). Using the long side of the template (10), place the template (10) over one of the remaining pins (18) along the trimmed edge. Align the template (10) with the trimmed edge. At the corner of the folded and trimmed edge, pierce the fabric (20) through the hole (13) closest to the corner and insert an alignment pin (18). Continue fabric (20) piercing through the remaining holes (13) between the pins (18).

FIG. 2*f*. Repeating the process in FIG. 2*e*, lift and remove the template (10). Using the long side of the template (10), place the template (10) over the remaining pins (18) along the trimmed edge yet to be pierced. Align the template (10) with the trimmed edge. At the corner of the folded and trimmed edge, pierce the fabric (20) through the hole (13) closest to the corner and insert an alignment pin (18). Continue fabric (20) piercing through the remaining holes (13) between the pins (18). At this point the process is complete and the fabric is prepared to receive the decorative edging.

What is claimed is:

1. A template for squaring trimming and piercing a substrate, consisting of a flat, transparent and triangular plastic template having a thickness of approximately 0.125" of an inch, said template defining a rounded corner connecting two of said straight sides and opposite a hypotenuse side of the triangular template, wherein the holes at the rounded corner are equally spaced apart from each other at approximately 0.375" of an inch and spaced from the edge approximately 0.375" of an inch; said template also having equally spaced holes provided along the straight sides of the triangular template, said holes being spaced apart from each other approximately 0.500" of an inch and spaced from the edge approximately 0.375" of an inch along the three straight sides; wherein said holes allow for a pointed object to pierce the substrate leaving an exposed hole to receive a decorative edge.

2. The template as claimed in claim 1 wherein said holes are of equal diameter (3/32").

3. The template as claimed in claim 1 is transparent providing the consumer with an unobstructed view of the piercing operation for accuracy and safety purposes.

4. The template holes as claimed in claim 1 said holes could also be used to mark a consistent and accurate layout on substrate.

* * * * *